US006189809B1

(12) United States Patent
Schwebemeyer

(10) Patent No.: US 6,189,809 B1
(45) Date of Patent: Feb. 20, 2001

(54) MULTI-FEED SPRAY GUN

(75) Inventor: Gary Schwebemeyer, Sylvania, OH (US)

(73) Assignee: Illinois Tool Works Inc., Glenview, IL (US)

( * ) Notice: Under 35 U.S.C. 154(b), the term of this patent shall be extended for 0 days.

(21) Appl. No.: 09/404,023

(22) Filed: Sep. 23, 1999

(51) Int. Cl.[7] ..... B05B 7/00

(52) U.S. Cl. ..... 239/304; 239/318; 239/345; 239/DIG. 14

(58) Field of Search ..... 239/303–307, 239/310, 311, 318, 345, 369, 379, DIG. 14

(56) References Cited

U.S. PATENT DOCUMENTS 4,288,036 * 9/1981 Jubinville ..... 239/345
5,344,074 * 9/1994 Spriggs et al. ..... 239/305 X

FOREIGN PATENT DOCUMENTS

1242480 * 8/1960 (FR) ..... 239/306
87/01680 * 3/1987 (WO) ..... 239/304

* cited by examiner

*Primary Examiner*—Lesley D. Morris
(74) *Attorney, Agent, or Firm*—Pitney, Hardin, Kipp and Szuch LLP

(57) ABSTRACT

The paint spray gun includes an upper passageway for receiving gravity fed paint from an upper paint cup and a lower passageway for receiving suction fed paint from a lower paint cup or pressure fed paint from a remote pressurized paint tank via a hose. Plugs are provided to block the upper or lower passageway when the corresponding other passageway is being used.

8 Claims, 2 Drawing Sheets

MULTI-FEED SPRAY GUN

BACKGROUND OF THE INVENTION

1. Field of the Invention

The present invention relates to a spray gun for paint and similar media which can be pressure fed, suction fed or gravity fed.

2. Description of the Prior Art

Spray guns for paint and similar media typically have a gravity feed, a suction feed or a pressure feed paint delivery system.

Gravity feed spray guns typically use a paint container on top of the spray gun, and the paint is fed by its own weight and atmospheric pressure, by gravity, into the spray gun. Gravity feed allows spraying of heavy materials, uses all of the material in the cup and is gaining wide popularity in automotive refinishing. Further, gravity feed requires less air pressure for operation than the suction or "siphon" feed method. The use of liners allows for simple cleaning of the device after use and provides for upside-down spraying. Gravity feed spray guns are disclosed in U.S. Pat. No. 5,727,736 entitled "Spray Applicator with Air Shut-Off Valve" issued on Mar. 17, 1998 to Tryon and U.S. Pat. No. 4,811,904 entitled "Spray Medium Inset for Spraying Pistols and a Spraying Pistol Suitable for Application of Such Insets" issued on Mar. 14, 1989 to Ihmels et al.

Suction feed spray guns use a suction created by a pressurized air source to draw the paint from a container up into the pressurized air stream. Suction feed typically allows larger quantities of paint to be used compared to gravity feed systems. Additionally, different paints or colors can be stored in different suction feed cups ready for use. Suction feed paint sprayers have achieved wide popularity among many end user segments. A suction feed spray gun is disclosed in U.S. Pat. No. 5,655,714 entitled "Pivotable Syphon Tube" and issued on Aug. 12, 1997 to Kieffer et al.

Pressure feed spray guns use a pressurized air line to the paint container to pressurize the paint and force it into the spray gun. Pressure feed allows spraying of extremely heavy materials, particularly when a large paint capacity is required, such as more than one quart. Pressure feed allows the spray gun to be held upside-down while spraying without the concern of leaks or drips. Moreover, a pressure feed spray gun is light because the paint supply can be separate from the spray gun.

Therefore, different paint applications and different users may choose different spray guns—gravity feed, suction feed or pressure feed. However, a single user may be reluctant to acquire spray guns of all three types. U.S. Pat. No. 4,760,962 entitled "Spray Gun Paint Cup and Lid Assembly" issued on Aug. 2, 1988 to Wheeler provides for the selection of pressure feed or suction feed but does not provide for gravity feed. Additionally, the configurations required for the two different feeds may not be intuitively obvious to a user. Similarly, U.S. Pat. No. 4,174,071 entitled "Spray Gun Assembly" issued on Nov. 13, 1979 to Lau et al. discloses a spray gun with an optionally pressurized paint supply. U.S. Pat. No. 5,069,389 entitled "Adapter for an Air Spray Gun" issued on Dec. 3, 1991 to Bitsakos provides a gravity feed attachment to a conventional spray gun. U.S. Pat. No. 5,582,350 entitled "Hand Held Paint Spray Gun with Top Mounted Paint Cup", issued on Dec. 10, 1996 to Kosmyna et al. discloses a hand held paint spray gun with a top mounted paint cup. The spray gun can operate as both a gravity and a suction feed.

OBJECTS AND SUMMARY OF THE INVENTION

It is therefore an object of this invention to provide a spray gun which can be configured as a gravity feed spray gun with all of the advantages thereof.

It is therefore a further object of this invention to provide a spray gun which can be configured as a pressure feed spray gun with all of the advantages thereof.

It is therefore a still further object of this invention to provide a spray gun which can be configured as a suction feed spray gun with all of the advantages thereof.

It is therefore a still further object of this invention to provide a spray gun in which the respective gravity, pressure and suction feed mode configurations are intuitively obvious to the user.

These and other objects are attained by providing a paint spray gun with an upper feed passageway and a lower feed passageway. The upper feed passageway is used during the gravity feed mode and is blocked during the suction and pressure feed modes. The lower feed passageway is used during the suction and pressure feed modes and is blocked during the gravity feed mode. A fluid hose leading from a remote pressurized paint tank is used during the pressure feed mode to feed paint through the lower feed passageway. A paint cup leading to the lower feed passageway is used during the suction feed mode.

BRIEF DESCRIPTION OF THE DRAWINGS

Further objects and advantages of the invention will become apparent from the following description and claims, and from the accompanying drawings, wherein:

DETAILED DESCRIPTION OF THE PREFERRED EMBODIMENT

Figure 1:
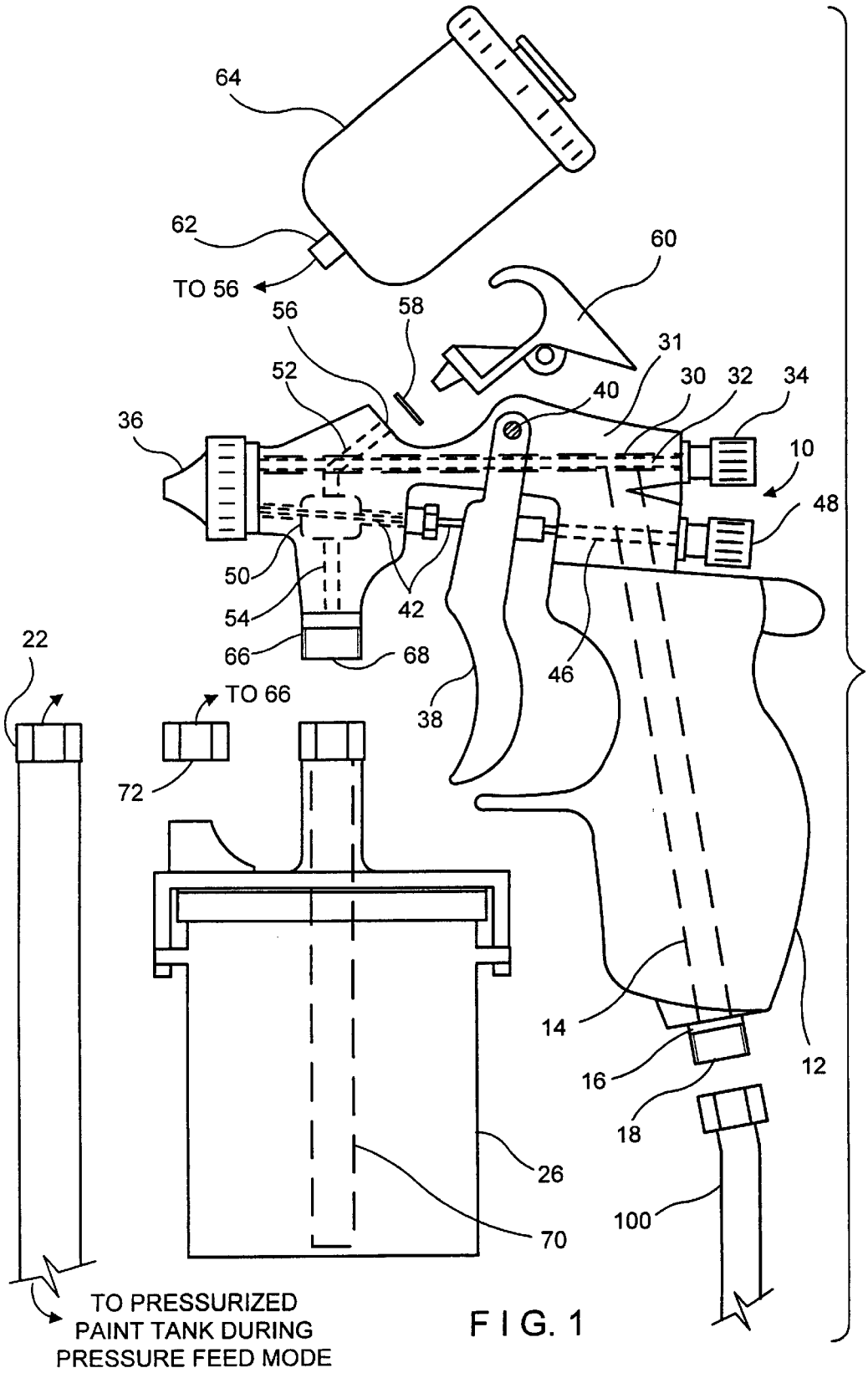
FIG. 1 is a cross-sectional view, partially in phantom, of the spray gun of the present invention.

Referring now to the drawings in detail wherein like numerals refer to like elements throughout the several views, one sees that FIG. 1 is a cross-sectional view, partially in phantom, of the spray gun 10 of the present invention. Spray gun 10 includes pistol grip 12 through which air passageway 14 extends. Lower end 16 of pistol grip 12 receives compressed air hose 100 through aperture 18.

Air passageway 14 leads to air needle valve passageway 30 which leads horizontally through body 31 of spray gun 10. Air needle valve passageway 30 contains air needle valve 32 which is controlled by air needle valve knob 34 to control the flow of pressurized air therethrough to nozzle 36.

Trigger 38 is pivotably attached to body 31 of spray gun 10 on pivot point 40. Trigger 38 is affixed to paint needle valve 42 which travels with forward paint needle valve channel 44 and rear paint needle valve channel 46. Rear paint needle valve channel 46 is rearwardly bounded by paint needle valve knob 48. Forward paint needle valve channel 44 is bounded by nozzle 36 which is controlled by the relative insertion or retraction of paint needle valve 42 therein. Enlarged paint chamber 50 is formed within forward paint needle valve channel 44. Enlarged paint chamber 50 is in fluid communication with upper feed passageway 52 and lower feed passageway 54. Upper feed chamber 52 extends to upper aperture 56 in the upper surface of body 31. In the suction feed and pressure feed modes, upper aperture 56 is blocked by removable plug 60 and washer 58. Removable plug 60 is typically shaped as a gun hook assembly. However, in the gravity feed mode, upper aperture 56 communicates with feed 62 of gravity feed cup 64. In this gravity feed mode, paint is fed from gravity feed cup 64, through upper feed passageway 52 to enlarged paint chamber 50. From enlarged paint chamber 50, paint is drawn to nozzle 36 and out nozzle 36 by the compressed air passing through air needle valve passageway 30. Preferably, upper feed passageway 52 does not intersect air needle valve passageway 30.

Lower feed passageway 54 extends downwardly from enlarged paint chamber 50 and axially through threaded stem 66 to lower aperture 68. In the pressure feed and suction feed configurations, feed tube 70 extends downwardly from lower aperture 68 and paint cup 26 is threadably attached to threaded stem 66. In the pressure feed mode, hose 22 is attached to threaded stem 66 and receives paint from a remote pressure-fed paint tank (not shown). The paint is thereby forced up lower feed passageway 54 to enlarged paint chamber 50 and out nozzle 36. In the suction feed mode, paint cup 26 is attached to threaded stem 66. The passage of pressurized air through air needle valve passageway 30 and nozzle 36 creates a suction which draws paint up through feed tube 70 and lower feed passageway 54 to enlarged paint chamber 50 and nozzle 36. In the gravity feed mode, paint cup 26 is omitted and lower aperture 68 is blocked by threaded plug 72.

Figure 2:
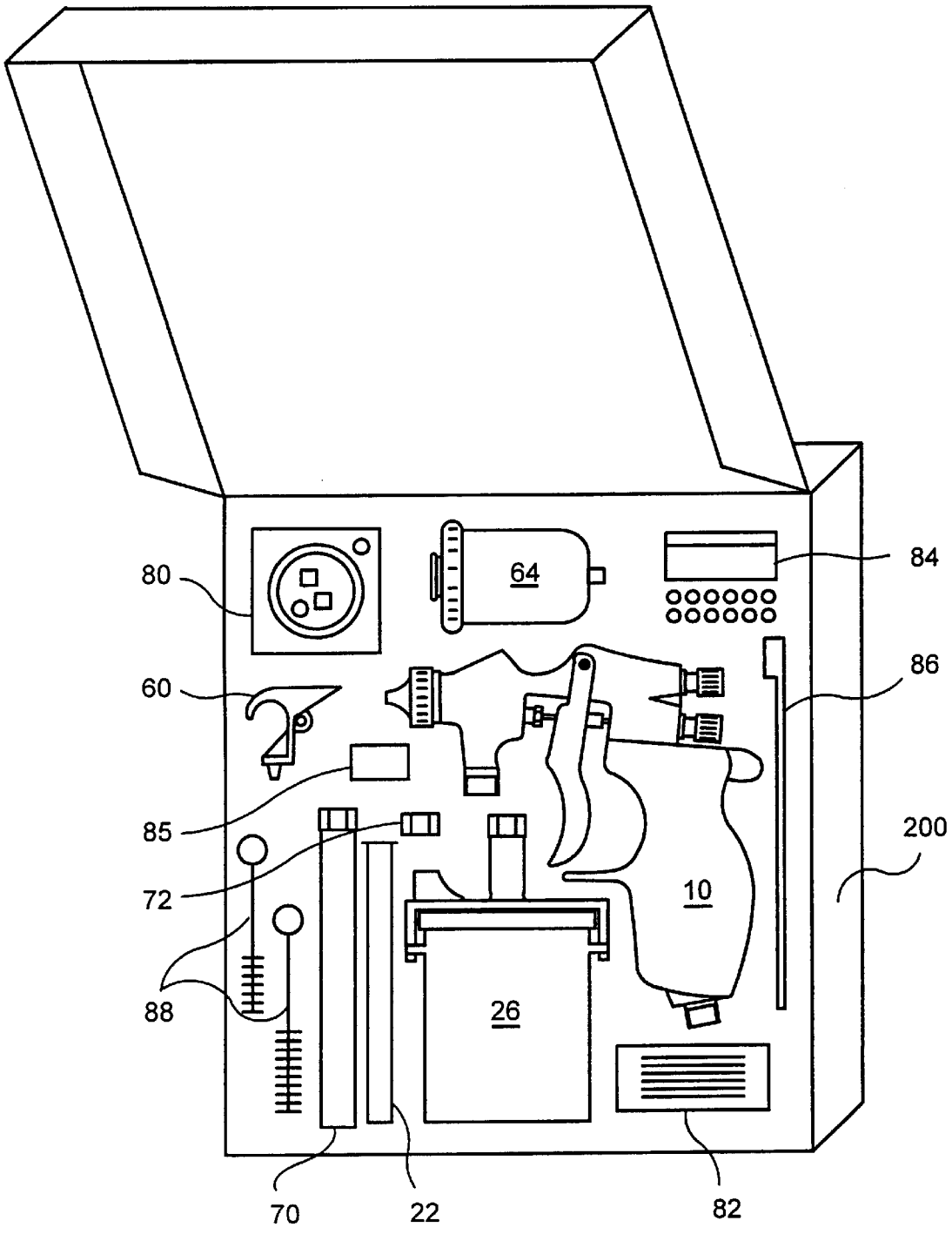
FIG. 2 is a perspective view of the spray gun of the present invention, including the various attachments to effect the various feed configurations.

FIG. 2 shows a typical packaging configuration for consumer purposes, including spray gun 10, paint cup 26, hose 22, gravity feed cup 64, feed tube 70, threaded plug 72, along with repair kit 80, instructions 82, roll of liners 84 (for gravity feed cup 64), bushings 85, bushing tool 86, and cleaning brushes 88, all contained within package 200.

To use spray gun 10, the user decides which configuration is desired and attaches the devices as described hereinabove. That is, in the pressure feed mode, hose 22 is attached to threaded stem 66 and a remote pressurized paint tank (not shown). Additionally, washer 58 and removable plug 60 are inserted into upper aperture 56. In the suction feed mode, paint cup 26 is attached to threaded stem 66 and hose 22 is omitted. Washer 58 and removable plug 60 are similarly installed. In the gravity feed mode, hose 22, paint cup 26, washer 58 and removable plug 60 are omitted and threaded plug 72 and gravity feed cup 64 are installed.

Thus the several aforementioned objects and advantages are most effectively attained. Although a single preferred embodiment of the invention has been disclosed and described in detail herein, it should be understood that this invention is in no sense limited thereby and its scope is to be determined by that of the appended claims.

What is claimed is:

1. A paint spray gun comprising;

a nozzle;

a passageway for receiving compressed air and directing compressed air to said nozzle;

chamber means for receiving paint to be directed to said nozzle, said chamber means including an upper passageway for receiving gravity fed paint and a lower passageway for receiving pressure or suction fed paint;

said upper passageway being selectively blockable when paint is received through said lower passageway; and said lower passageway being selectively blockable when paint is received through said upper passageway.

2. The paint spray gun of claim 1 further including an upper paint container in communication with said upper passageway for providing gravity fed paint.

3. The paint spray gun of claim 2 wherein said upper paint container is removed when said upper passageway is blocked.

4. The paint spray gun of claim 3 further including a lower paint container in communication with said lower passageway for providing suction fed paint.

5. The paint spray gun of claim 3 further including a hose in communication with said lower passageway for providing pressure fed paint.

6. The paint spray gun of claim 4 wherein said lower paint container is removed when said lower passageway is blocked.

7. The paint spray gun of claim 6 wherein said lower paint container is threadably attached to the lower passageway to provide suction fed paint and wherein said lower passageway is blocked by a threaded plug when paint is received through said upper passageway.

8. The paint spray gun of claim 5 wherein said hose is threadably attached to said lower passageway to provide pressure fed paint from a remote paint tank.

* * * * *